United States Patent [19]

Hecker

[11] 4,409,123

[45] Oct. 11, 1983

[54] SULFUR SORBENT REGENERATION PROCESS

[75] Inventor: William C. Hecker, Albany, Calif.

[73] Assignee: Chevron Research Company, San Francisco, Calif.

[21] Appl. No.: 362,755

[22] Filed: Mar. 29, 1982

[51] Int. Cl.[3] ..... B01J 23/94; B01J 23/92; C10G 29/16; C10G 29/04

[52] U.S. Cl. ..... 502/38; 208/243; 208/246; 502/52

[58] Field of Search ..... 252/411 S, 416, 419; 208/243, 246; 423/230 R, 244; 55/73

[56] References Cited

U.S. PATENT DOCUMENTS 2,372,084 3/1945 Jones ..... 208/243
4,008,174 2/1977 Jacobson et al. ..... 252/419
4,204,947 5/1980 Jacobson et al. ..... 252/419

FOREIGN PATENT DOCUMENTS 761049 11/1956 United Kingdom ..... 208/246

*Primary Examiner*—P. E. Konopka
*Attorney, Agent, or Firm*—Burns, Doane, Swecker & Mathis

[57] ABSTRACT

A process for regenerating a spent copper-porous refractory metal oxide carrier composite for sorbing sulfur compounds from hydrocarbons in which the spent sorbent is optionally stripped of hydrocarbons, oxidized to convert absorbed sulfur to a sulfate form, and then purged with an inert gas at temperatures that decompose the sulfate form to sulfur dioxide, thereby reducing the sulfur content of the sorbent substantially.

7 Claims, No Drawings

SULFUR SORBENT REGENERATION PROCESS

BACKGROUND OF THE INVENTION

1. Field of the Invention

The invention relates to a process for regenerating a spent copper-based sorbent or scavenger for removing sulfur-containing compounds from hydrocarbons.

2. Description of the Art

U.S. Pat. No. 4,163,708 describes the use of composites of copper compounds and inorganic porous carriers for removing thiol impurities from hydrocarbons to prepare the hydrocarbons for catalytic reforming using platinum or platinum-containing bimetallic catalysts that are poisoned by thiol compounds. The patent teaches that spent composites may be regenerated in a three-stage regeneration process. In the first stage adhered hydrocarbons are stripped from the spent sorbent (scavenger) with a stripping gas. After the stripping, the sorbent is subjected to oxidizing conditions to oxidize residual carbon, hydrocarbon, and sulfur compounds on the sorbent. Gas containing a small volume percent of molecular oxygen at 190° C. to 260° C. is a suggested oxidizing medium. The third and final stage of regeneration is to subject the sorbent to a reducing atmosphere to convert copper-sulfur-oxygen moieties on the scavenger to copper oxide/copper metal and sulfur dioxide. The sulfur dioxide is carried away by the reducing gas leaving only copper oxide/copper metal on the porous carrier. Nitrogen gas containing a few volume percent hydrogen at 188° C., 5.4–6.4 atm is suggested as a reducing medium.

Copending commonly owned U.S. application Ser. No. 367,070 describes a process for regenerating the sulfur sorbent of U.S. Pat. No. 4,163,708 in which after stripping, oxidation, and reduction, the sorbent is impregnated with a copper salt and then calcined to convert the impregnated salt to copper metal/copper oxide. This regeneration process is said to be especially useful for regenerating sorbents that do not contain an inherent catalytic oxidizing catalyst and have been used to remove primarily mercaptans from hydrocarbon feedstocks. The oxidation step in this regeneration is carried out at 400° C. to 650° C. The reduction step is optional and employs a reducing gas, typically nitrogen containing a few percent hydrogen at 500° C. to 700° C.

A principal object of the present invention is to provide a simple yet effective alternative regeneration process to those described above.

SUMMARY OF THE INVENTION

The invention is a process for regenerating a spent copper-inorganic porous carrier composite sorbent for removing thiol compounds from hydrocarbons comprising:

(a) contacting the spent sorbent with an oxidizing gas at a temperature and for a time sufficient to convert the sulfur in the sorbent to a sulfate form; and (b) purging the oxidized sorbent with an inert gas at an elevated temperature and for a time sufficient to convert substantially all of said sulfate form to sulfur dioxide whereby the sulfur content of the sorbent is reduced substantially, said elevated temperature being below that which would cause a deleterious change in the sorbent.

DETAILED DESCRIPTION OF THE INVENTION

The sorbents that are regenerated by the invention process are used to remove sulfur-containing compounds such as hydrogen sulfide and mercaptans from hydrocarbons that boil in the range of about 50° C. to 200° C. at 760 mm Hg. These hydrocarbons are typically derived from petroleum, oil shale, coal, tar, or other sources and include such refining streams as straight run and refined naphthas, hydrocrackates and fractions thereof, diesel oil, jet fuel oil, and kerosene. Preferably, the hydrocarbon is a feedstock to a catalytic reforming process that employs a platinum or platinum-containing bimetallic reforming catalyst. These hydrocarbons will normally contain about 1 to about 10 wppm sulfur before being treated with the sorbent.

The sorbent comprises in its fresh form copper metal and/or copper oxide on an inorganic porous refractory carrier. The copper component will usually constitute about 5% to 50% by weight, preferably 20% to 40% by weight, of the sorbent, calculated as copper metal. The carrier will typically be a natural or synthetic refractory oxide of a Group II, III, or IV metal or mixtures thereof. Examples of such carriers are alumina, silica, silica-alumina, boria, kieselguhr, pumice, and clays such as attapulgite. The carrier or the sorbent per se will usually have a specific surface area (measured by the B.E.T. method) in the range of about 50 to 250 $m^2/g$, preferably 100 to 200 $m^2/g$. The average particle diameter of the sorbent will usually be between about 0.08 to about 0.3 cm.

The sorbent may be made by impregnating the carrier with an aqueous solution of a water soluble copper salt, the anionic portion of which may be readily removed from the composite after or upon drying. An alternative and preferred method for making the sorbent is by comulling particulate carrier and insoluble particulate copper carbonate in a concentrated aqueous slurry, extruding the mixture into pellets, and calcining the pellets to drive carbon dioxide off the copper carbonate. This comulling method is described in U.S. Pat. No. 4,259,213.

Sulfur-containing compounds are removed from the hydrocarbon by contacting the hydrocarbon with the sorbent at temperatures in the range of about 60° C. to about 250° C., preferably 80° C. to 180° C., and pressures that maintain the hydrocarbon in the liquid phase. Such contacting may be carried out by passing the hydrocarbon through one or more fixed bed downflow or upflow sorbing drums charged with the sorbent. The liquid hourly space velocity (LHSV) will typically be in the range of 3 to 15. Such contacting will usually remove sulfur-containing compounds from the hydrocarbon to the extent that the sulfur content of the effluent from the sorbent bed(s) is less than about 0.5 wppm, preferably less than 0.2 wppm. Once the sorbent is saturated with sulfur compounds, the sorbent is spent and must be regenerated. This end point may be determined by monitoring the sulfur content of the effluent, with the end point being indicated by a rise in sulfur content above about 20% by weight of the sulfur content of the feed. In most instances the end point will be indicated by an effluent sulfur content above about 1 or 2 wppm.

The spent sorbent is regenerated according to the invention process as follows. If the spent sorbent contains substantial amounts of residual hydrocarbons, it is desirable to strip the hydrocarbons from the sorbent before the sorbent is subjected to the oxidizing gas. Stripping gases such as nitrogen, hydrogen, steam, carbon dioxide, or mixtures thereof may be used. The stripping may be carried out at the temperatures used in the sulfur removal (80° C.–180° C.) and may be facilitated by lowering the system pressure from the pressures used in the sulfur removal. Stripping is complete when the stripping gas effluent is substantially free of hydrocarbons.

The next step in the regeneration is contacting the hydrocarbon-stripped sorbent with an oxidizing gas at an elevated temperature, usually in the range of 300° C. to 700° C., and more usually in the range of 450° C. to 650° C. Residual carbon and any residual hydrocarbons on the sorbent are oxidized in this step to carbon dioxide and water whereas the sulfur (in the form of absorbed thiols) is oxidized to a sulfate form. The sulfate form is believed to be a copper sulfate complex, $Cu_2O(SO_4)$ (dolerophanite). The contact time should be sufficient to convert substantially all the sulfur to sulfate. Use of longer contact times are not detrimental and will merely convert a portion of the sulfate to sulfur dioxide which is liberated into the oxidizing gas. The oxidizing gas may be air or mixtures of nitrogen and oxygen that contain less oxygen than air. The GHSV used in the oxidation step will depend upon the oxygen content of the oxidizing gas and the duration of the step. For air the GHSV will typically be 100 for a minimum of 10 hrs. For 2% oxygen in nitrogen, the GHSV will typically be 1000 for a minimum of 10 hrs. Such conditions will be sufficient to oxidize the copper sulfide to dolerophanite.

After the oxidation the scavenger is purged with an inert gas, such as nitrogen, argon, helium or mixtures thereof, at temperatures that decompose the sulfate to sulfur dioxide. Normally the temperature will be in excess of 500° C., usually between 550° C. and 700° C. Lower temperatures may require impractical purge times and/or favor the formation of sulfur trioxide which might react with the carrier. Higher temperatures cause formation of $CuAl_2O_3$ which can cause loss of sorbent capacity. This purge is different from the reduction steps in the prior art regenerations in that an inert purge gas rather than a hydrogen-containing reducing gas is employed in the invention process. Surprisingly, the absence of hydrogen in the gas results in a more complete removal of sulfur from the sorbent. The GHSV used in the inert purge is not critical. Indeed adequate regeneration at 0 GHSV (stagnancy) was achieved in the laboratory. GHSVs in the range of about 100 to 10,000 will normally be used in the inert purge. The completion of the purge may be monitored either by analyzing the purge gas effluent for sulfur dioxide or by measuring the sulfur content of the purged sorbent. In any event the purge reduces the sulfur content of the sorbent to below about 1.5% by weight, typically below about 1% by weight, preferably below about 0.7% by weight.

The stripping step of the regeneration, if necessary, will typically be carried out in the sorbing vessels which will, of course, be equipped with lines, valves, and other mechanisms required to pass the stripping gas through the vessels and regulate the temperatures and pressures in the vessels to those ranges required for the step. The oxidation and purge steps will usually require removal of the sorbent from the sorbing vessels and placement in other vessels or containers. The oxidation and purge steps may be carried out by placing the stripped sorbent into a fixed bed downflow or upflow reactor vessel and passing the oxidizing/purge gases sequentially through the sorbent bed at the desired temperatures and flow rates until the oxidation/purge is complete.

The following examples further illustrate the invention process and compare it to a prior art process using a reduction step versus an inert purge step. These examples are not intended to limit the invention in any manner.

EXAMPLE 1

A spent sulfur sorbent was regenerated as follows. The original (prior to use) composition and properties of the sorbent were CuO 26% by weight calculated as metal
Alumina 67.5% by weight
Pore Volume 0.55 cc/g
Average Pore Size 120 A°
Average Particle Size 0.16 cm This sorbent was made by the basic process described in U.S. Pat. No. 4,259,213 and had been used to remove sulfur compounds from petroleum naphtha feedstocks. In its spent condition it contained approximately 7% by weight sulfur.

The spent sorbent was stripped of hydrocarbons and oxidized with air at temperatures in the range of 480° C. to 700° C. for five hours. The oxidized sorbent contained 4.1% by weight sulfur. Samples of the oxidized sorbent were placed in a quartz reactor and purged with pure nitrogen at 620° C. and 650° C., respectively. The GHSV in the 620° C. run was 960 and 2,400 in the 650° C. run. For comparison purposes a sample of the oxidized sorbent was reduced with pure hydrogen at 510° C., GHSV 2400, for five hours. The weight percent sulfur remaining on the sorbent after each of these treatments was as follows:

| Run | W % Sulfur |
|---|---|
| $N_2$, 650° C. | 0.5 |
| $N_2$, 620° C. | 0.75 |
| $H_2$, 510° C. | 2.4 |

EXAMPLE 2

The spent sulfur sorbent of Example 1 was regenerated by subjecting it to oxidation using two vol % $O_2$ in nitrogen followed by inert $N_2$ purges at various temperatures. For comparison purposes regenerations were also carried out by oxidation followed by conventional reducing using two vol % $H_2$ in nitrogen at various temperatures. All treatments employed a GHSV of 2,400 and were carried out for five hours. The sulfur content of the sorbent after each treatment was determined. The details of these regenerations are reported below.

| Treatment Temperature, °C. | | | |
|---|---|---|---|
| 2 v % $O_2$ | 100% $N_2$ | 2 v % $H_2$ | W % Sulfur |
| 510 | 650 | — | 0.7 |
| 650 | 540 | — | 1.0 |
| 650 | 650 | — | 0.65 |
| 510 | — | 650 | 2.2 |
| 650 | — | 540 | 1.2 |
| 650 | — | 650 | 1.1 |

The above examples show that sulfur may be removed from the spent sorbent more effectively by using a high temperature inert purge than by using a high temperature reduction.

EXAMPLE 3

A spent sulfur sorbent having the same original composition as the sorbent of Example 1 and 7.5% by weight sulfur in its spent condition was regenerated as follows.

A sample of the spent sorbent was placed in a laboratory reactor and it was oxidized with a 2 vol % $O_2$ oxidizing gas at 650° C., GHSV 2800 for 11 hr. Following the oxidation the flow of oxidizing gas was discontinued and the sorbent was held under essentially inert, stagnant conditions at 650° C. for 6 hr. The thus regenerated sorbent contained 1.1% by weight sulfur.

The extent of regeneration of the sorbent was determined by using it to remove $H_2S$ from a Mid-Continent petroleum naphtha. The sorbent was placed in a laboratory size sorbing vessel as the naphtha, containing 8 wppm $H_2S$ sulfur, was passed through the vessel at about 95° C., 200 psig, and LHSV of 15. The time to breakthrough (the run time at which the sulfur in the vessel effluent was 20% of the sulfur in the feed, i.e. 1.6 wppm) was 480 hr. This time to breakthrough was compared to the time breakthrough of a comparable run using fresh sorbent to determine the regenerated sorbent's lifetime. The regenerated sorbent's lifetime based on breakthrough time was 94% of the lifetime of the fresh sorbent. Lifetime calculations based on a comparison between the amounts of sulfur contained on the regenerated sorbent and the fresh sorbent at breakthrough indicated the regenerated material's lifetime was 84% that of the fresh material.

EXAMPLE 4

A spent sulfur sorbent having the same original composition as the sorbent of Example 1 and 7.6% by weight sulfur in its spent condition was regenerated as follows.

A sample of the spent sorbent was placed in a laboratory reactor and it was oxidized with 2 vol % $O_2$ oxidizing gas, GHSV 4,000 with a slow heatup from 425° C. to 650° C. The reaction time was 5 hr. Following the oxidation, the sorbent was purged with $N_2$ at 650° C., GHSV 2000, for 5 hr. The thus regenerated sorbent contained 0.9% by weight sulfur.

The extent of regeneration of the sorbent was determined by using it to remove mercaptan sulfur from a Mid-Continent petroleum naphtha. The sorbent was placed in a laboratory size sorbing vessel as the naphtha, containing 18 wppm mercaptan sulfur, was passed through the vessel at about 165° C., 150 psig, 7.4 LHSV. The time to breakthrough, determined as in Example 3, was 265 hr. This time to breakthrough was compared to the time to breakthrough of a comparable run using fresh sorbent to determine the regenerated sorbent's lifetime. That lifetime was 78% of the lifetime of the fresh sorbent. Lifetime calculations based on a comparison of the amounts of sulfur contained on the regenerated material's lifetime was 90% that of the fresh material.

Modifications of the above described modes for carrying out the invention process that are obvious to those of ordinary skill in the chemical, sorbent, and/or refining arts are intended to be within the scope of the following claims.

I claim:

1. A process for regenerating a spent copper-inorganic porous carrier composite sorbent for removing thiol compounds from hydrocarbons comprising:

(a) contacting the spent sorbent with an oxidizing gas at a temperature in the range of 300° C. to 700° C. and for a time sufficient to convert the sulfur in the sorbent to a sulfate form; and (b) purging the oxidized sorbent with a nonreducing inert gas at an elevated temperature of at least about 500° C. and for a time sufficient to convert substantially all of said sulfate form to sulfur dioxide whereby the sulfur content of the sorbent is reduced substantially, said elevated temperature being below that which would cause a deleterious change in the sorbent, said purging with an inert gas being performed after step (a) without an intervening step in which the oxidized sorbent is contacted with a reducing gas.

2. The process of claim 1 wherein the sulfur content is reduced to not more than about 1.5% by weight.

3. The process of claim 1 wherein the sulfur content is reduced to not more than about one percent by weight.

4. The process of claim 1 wherein the said elevated temperature is in the range of about 550° C. to about 700° C.

5. The process of claim 1 wherein the temperature of step(a) is in the range of about 450° C. to about 650° C.

6. The process of claim 1 wherein the inert gas is nitrogen.

7. The process of claim 1 wherein the temperature of step(a) is in the range of about 450° C. to about 650° C., the inert gas is nitrogen, the elevated temperature is in the range of about 550° C. to 700° C., and the sulfur content is reduced to below about one percent by weight.

* * * * *